US008402950B2

(12) United States Patent
Fujino et al.

(10) Patent No.: US 8,402,950 B2
(45) Date of Patent: Mar. 26, 2013

(54) FUEL INJECTOR WITH FUEL PRESSURE SENSOR AND ELECTRICAL INTERCONNECTION METHOD OF THE SAME

(75) Inventors: Tomoki Fujino, Okazaki (JP); Jun Kondo, Nagoya (JP); Yutaka Miyamoto, Takahama (JP)

(73) Assignee: Denso Corporation, Kariya (JP)

( * ) Notice: Subject to any disclaimer, the term of this patent is extended or adjusted under 35 U.S.C. 154(b) by 350 days.

(21) Appl. No.: 12/753,339

(22) Filed: Apr. 2, 2010

(65) Prior Publication Data

US 2010/0252002 A1 Oct. 7, 2010

(30) Foreign Application Priority Data

Apr. 3, 2009 (JP) ..... 2009-090734

(51) Int. Cl.
*F02M 51/00* (2006.01)
*F02M 51/06* (2006.01)

(52) U.S. Cl. ..... 123/494; 123/472

(58) Field of Classification Search ..... 123/472, 123/494, 498; 701/103; 73/114.45, 114.51
See application file for complete search history.

(56) References Cited

U.S. PATENT DOCUMENTS 4,295,115 A * 10/1981 Takahashi et al. ..... 338/4
5,988,142 A * 11/1999 Klopfer ..... 123/446
6,155,874 A 12/2000 Endo et al.
6,622,549 B1 * 9/2003 Wlodarczyk et al. ..... 73/114.51
2008/0228374 A1 9/2008 Ishizuka et al.
2009/0241650 A1 * 10/2009 Kondo et al. ..... 73/114.43
2009/0248276 A1 * 10/2009 Kondo et al. ..... 701/103
2010/0096480 A1 * 4/2010 Kondo et al. ..... 239/584
2012/0149256 A1 * 6/2012 Serizawa et al. ..... 439/884

FOREIGN PATENT DOCUMENTS

JP H11-008023 1/1999
JP 2000-161176 A 6/2000
JP 2008-144749 6/2008
WO WO 2009/019663 2/2009

OTHER PUBLICATIONS

Japanese Office Action dated Nov. 6, 2012, issued in corresponding Japanese Application No. 2009-090734, with English translation.

* cited by examiner

*Primary Examiner* — Mahmoud Gimie
(74) *Attorney, Agent, or Firm* — Nixon & Vanderhye PC

(57) ABSTRACT

In a fuel injector, a body has formed therein a spray hole and a fuel supply passage. Fuel supplied to the fuel supply passage is delivered to the spray hole. A fuel pressure sensor produces a signal indicative of a pressure of the fuel. First terminals are attached to the fuel pressure sensor, and include a terminal for outputting the signal. The fuel pressure sensor is threadedly installed in the body while the plurality of first terminals are rotated about a preset axis. A connector includes a housing attached to the body, and second terminals supported by the housing for external electric connection of the fuel pressure sensor. Electrodes are each arranged to extend around the preset axis in a circular arc. Each of the electrodes electrically connects a corresponding one of the first terminals to a corresponding one of the second terminals.

16 Claims, 7 Drawing Sheets

FUEL INJECTOR WITH FUEL PRESSURE SENSOR AND ELECTRICAL INTERCONNECTION METHOD OF THE SAME

CROSS REFERENCE TO RELATED APPLICATIONS

This application is based on Japanese Patent Application 2009-090734 filed on Apr. 3, 2009. This application claims the benefit of priority from the Japanese Patent Applications, so that the descriptions of which are all incorporated herein by reference.

FIELD OF THE INVENTION

The present invention relates to fuel injectors each having a fuel pressure sensor, and electrical interconnection methods of fuel injectors. More particularly, the present invention relates to such fuel injectors installable in an internal combustion engine; these fuel injectors working to spray fuel via their spray holes. In addition, the present invention relates to electrical interconnection methods of these fuel injectors.

BACKGROUND OF THE INVENTION

Fuel injectors are operative to spray, via their spray holes, high-pressurized fuel supplied from a common rail, such as a fuel accumulator, in which high-pressurized fuel is charged. These fuel injectors are installed in internal combustion engines and operative to spray high-pressurized fuel into cylinders of the internal combustion engines.

In order to control, with high accuracy, the output torque of internal combustion engines and the characteristics of emissions therefrom, it is required to properly adjust fuel-spray characteristics of fuel injectors, such as the fuel-spray start timing of each fuel injector and the quantity of fuel to be sprayed therefrom.

For meeting such a requirement, there have been proposed techniques that monitor the change in pressure of fuel caused when a fuel injector sprays fuel.

One of the techniques uses a fuel pressure sensor provided directly in the common rail and operative to measure the pressure of fuel charged in the common rail. However, in this technique, the change in pressure of fuel caused when the fuel injector sprays fuel may be somewhat absorbed within the common rail; these results may reduce the accuracy of measuring such a pressure change.

In order to address such a drawback, US Patent Application Publication No. 2008/0228374 corresponding to Japanese Patent Application Publication No. 2008-144749 discloses an alternative one of the techniques that uses a fuel pressure sensor installed in a fuel injector.

Specifically, this technique aims at measuring the change in pressure of fuel caused when the pressure-sensor installed fuel injector sprays fuel without the pressure change being absorbed within the common rail.

SUMMARY OF THE INVENTION

The inventors have proposed fuel injectors designed such that fuel pressure sensors are threaded in their bodies.

In such a fuel injector having this design, a plurality of terminals (sensor terminals), such as an external output terminal, a power supply terminal, a ground terminal, and the like, are attached to the fuel pressure sensor, and a plurality of connector terminals for external connection of the sensor terminals are attached to the body of the fuel injector. The sensor terminals and the connector terminals are electrically connected to each other for driving the fuel pressure sensor and outputting detection signals thereby.

In producing a plurality of fuel injectors each having the design, because the fuel pressure sensor is screwed about its axial direction into the body of each fuel injector, at the moment when the screwing of the fuel pressure sensor into the body of each fuel injector is completed, rotational positions of the sensor terminals of the fuel pressure sensors may be unspecified among the fuel injectors.

On the other hand, the connector terminals are required to be attached to predetermined positions of the body of each fuel injector. For this reason, it may be difficult to locate the sensor terminals of the fuel pressure sensor to positions to be easily connectable to the connector terminals of the body of a corresponding fuel injector. In other words, it may be difficult to locate the sensor terminals of the fuel pressure sensor in line with the connector terminals of the body of a corresponding fuel injector.

In addition, the sensor terminals of the fuel pressure sensor should be electrically connected to the connector terminals of the body of a corresponding fuel injector, respectively. However, because the sensor terminals of the fuel pressure sensor are out of line with the connector terminals of the body of a corresponding fuel injector, it may be difficult to electrically connect the sensor terminals of the fuel pressure sensor to the connector terminals of the body of a corresponding fuel injector, respectively.

In view of the circumstances set force above, the present invention seeks to provide fuel injectors with fuel pressure sensors, each of which is designed to facilitate respective electrical connections between a plurality of terminals of the fuel pressure sensor and a plurality of terminals of a connector for external electric connection of the fuel pressure sensor. The present invention also seeks to provide electrical interconnection methods of such fuel injectors.

According to one aspect of the present invention, there is provided a fuel injector to be installed in an internal combustion engine to spray fuel from a spray hole. The fuel injector includes a body having formed therein a spray hole and a fuel supply passage. The fuel supply passage is designed such that fuel supplied thereto is delivered to the spray hole. The fuel injector includes a fuel pressure sensor designed to produce a signal indicative of a pressure of the fuel, and a plurality of first terminals attached to the fuel pressure sensor and including at least one terminal for outputting the signal indicative of the pressure of the fuel. The fuel pressure sensor is threadedly installed in the body while the plurality of first terminals are rotated about a preset axis. The fuel injector includes a connector comprising a housing attached to the body, and a plurality of second terminals supported by the housing for external electric connection of the fuel pressure sensor. The fuel injector includes a plurality of electrodes each arranged to extend around the preset axis in a circular arc, each of the plurality of electrodes electrically connecting a corresponding one of the plurality of first terminals to a corresponding one of the plurality of second terminals.

With the configuration of each of the fuel injectors of this one aspect, the plurality of circular-arc electrodes are arranged to extend around the preset axis about which the plurality of first terminals are rotated when the fuel pressure sensor is threadedly installed in the body of the fuel injector.

Thus, although the rotational positions of the plurality of first terminals are not specified between the individual fuel injectors of this one aspect, a portion, such as a connector portion, of each of the plurality of first terminals or of each of the plurality of second terminals to be electrically connected to a corresponding one of the plurality of circular-arc electrodes can be easily located to face the corresponding one of the plurality of circular-arc electrodes because the trajectory of the rotating first terminals can be easily expected to include a circular-arc around the preset axis. Thus, it is possible to easily establish electrical connections between each of the plurality of first terminals or each of the plurality of second terminals and a corresponding one of the plurality of circular-arc electrodes.

For example, when the fuel pressure sensor is threadedly installed in the body while the plurality of electrodes are electrically connected to the plurality of first terminals, respectively, it is possible to easily locate the connector portion of each of the plurality of second terminals so as to face the corresponding one of the plurality of circular-arc electrodes.

In addition, when the fuel pressure sensor is threadedly installed in the body without the plurality of electrodes being electrically connected to the plurality of first terminals, it is possible to easily locate the connector portion of each of the plurality of first terminals so as to face the corresponding one of the plurality of circular-arc electrodes.

Accordingly, it is possible to eliminate the need to align each of the plurality of first terminals with a corresponding one of the plurality of second terminals. This makes it possible to easily establish electrical connections between each of the plurality of second terminals and a corresponding one of the plurality of first terminals via a corresponding one of the plurality of electrodes.

According to another aspect of the present invention, there is provided a fuel injector to be installed in an internal combustion engine to spray fuel from a spray hole. The fuel injector includes a body having formed therein a spray hole and a fuel supply passage, the fuel supply passage being designed such that fuel supplied thereto is delivered to the spray hole, and a fuel pressure sensor designed to produce a signal indicative of a pressure of the fuel. The fuel injector includes a plurality of first terminals attached to the fuel pressure sensor and including at least one terminal for outputting the signal indicative of the pressure of the fuel. The fuel pressure sensor is threadedly installed in the body while the plurality of first terminals are rotated about a preset axis. The fuel injector includes a connector attached to the fuel pressure sensor for external electric connection of the fuel pressure sensor, the connector having a plurality of second terminals. The fuel injector includes a plurality of electrodes each arranged to extend around the preset axis in a circular loop so that the plurality of electrodes are concentrically arranged, each of the plurality of electrodes electrically connecting a corresponding one of the plurality of first terminals to a corresponding one of the plurality of second terminals.

With the configuration of each of the fuel injectors of anther aspect, the plurality of circular-loop electrodes are arranged to extend around the preset axis about which the plurality of first terminals are rotated when the fuel pressure sensor is threadedly installed in the body of the fuel injector.

Thus, independently of the rotational positions of the plurality of first terminals, a portion, such as a connector portion, of each of the plurality of first terminals or of each of the plurality of second terminals to be electrically connected to a corresponding one of the plurality of circular-arc electrodes is located to face the corresponding one of the plurality of circular-loop electrodes because the trajectory of the rotating first terminals can be easily expected as a circular-loop around the preset axis.

Accordingly, it is possible to eliminate the need to align each of the plurality of first terminals with a corresponding one of the plurality of second terminals. This makes it possible to easily establish electrical connections between each of the plurality of second terminals and a corresponding one of the plurality of first terminals via a corresponding one of the plurality of electrodes.

According to a further aspect of the present invention, there is provided an electrical interconnection method of a fuel injector to be installed in an internal combustion engine to spray fuel from a spray hole. The fuel injector includes a body having formed therein a spray hole and a fuel supply passage. The fuel supply passage is designed such that fuel supplied thereto is delivered to the spray hole. The fuel injector includes a fuel pressure sensor designed to produce a signal indicative of a pressure of the fuel, and a plurality of first terminals attached to the fuel pressure sensor and including at least one terminal for outputting the signal indicative of the pressure of the fuel. The fuel pressure sensor is threadedly installed in the body while the plurality of first terminals are rotated about a preset axis. The fuel injector includes a connector comprising a housing attached to the body, and a plurality of second terminals supported by the housing for external electric connection of the fuel pressure sensor. The fuel injector includes a plurality of electrodes each arranged to extend around a preset axis in any one of a circular arc and a circular loop, each of the plurality of electrodes electrically connecting a corresponding one of the plurality of first terminals to a corresponding one of the plurality of second terminals. The electrical interconnection method includes: electrically connecting the plurality of electrodes to the plurality of first terminals of the fuel pressure sensor, respectively; and threadedly installing the fuel pressure sensor into the body of the fuel injector about the preset axis while the plurality of first terminals and the plurality of electrodes are rotated thereabout. The electrical interconnection method includes electrically connecting the plurality of second terminals to the plurality of electrodes, respectively.

In the electrical interconnection method of a fuel injector of this further aspect, although the rotational positions of the plurality of first terminals are not specified between the individual fuel injectors of this further aspect, a portion, such as a connector portion, of each of the plurality of first terminals or of each of the plurality of second terminals to be electrically connected to a corresponding one of the plurality of circular-arc or circular-loop electrodes can be easily located to face the corresponding one of the plurality of circular-arc electrodes.

Accordingly, it is possible to eliminate the need to align each of the plurality of first terminals with a corresponding one of the plurality of second terminals. This makes it possible to easily establish electrical connections between each of the plurality of second terminals and a corresponding one of the plurality of first terminals via a corresponding one of the plurality of electrodes.

According to a still further aspect of the present invention, there is provided an electrical interconnection method of a fuel injector to be installed in an internal combustion engine to spray fuel from a spray hole. The fuel injector includes a body having formed therein a spray hole and a fuel supply passage, the fuel supply passage being designed such that fuel supplied thereto is delivered to the spray hole, and a fuel pressure sensor designed to produce a signal indicative of a pressure of the fuel. The fuel injector includes a plurality of first terminals attached to the fuel pressure sensor and including at least one terminal for outputting the signal indicative of the pressure of the fuel. The fuel pressure sensor is threadedly installed in the body while the plurality of first terminals are rotated about a preset axis. The fuel injector includes a connector attached to the fuel pressure sensor for external electric connection of the fuel pressure sensor, the connector having a plurality of second terminals. The fuel injector includes a plurality of electrodes each arranged to extend around a preset axis in any one of a circular arc and a circular loop so that the plurality of electrodes are concentrically arranged, each of the plurality of electrodes electrically connecting a corresponding one of the plurality of first terminals to a corresponding one of the plurality of second terminals. The electrical interconnection method includes: electrically connecting the plurality of electrodes to any one of the plurality of first terminals of the fuel pressure sensor and the plurality of second terminals, respectively, and threadedly installing the fuel pressure sensor into the body of the fuel injector about the preset axis while the plurality of first terminals are rotated thereabout. The electrical interconnection method includes electrically connecting the other of the plurality of first terminals of the fuel pressure sensor and the plurality of second terminals to the plurality of electrodes, respectively.

In the electrical interconnection method of a fuel injector of this still further aspect, although the rotational positions of the plurality of first terminals are not specified between the individual fuel injectors of this further aspect, a portion, such as a connector portion, of each of the plurality of first terminals or of each of the plurality of second terminals to be electrically connected to a corresponding one of the plurality of circular-arc or circular-loop electrodes can be easily located to face the corresponding one of the plurality of circular-arc electrodes.

Accordingly, it is possible to eliminate the need to align each of the plurality of first terminals with a corresponding one of the plurality of second terminals. This makes it possible to easily establish electrical connections between each of the plurality of second terminals and a corresponding one of the plurality of first terminals via a corresponding one of the plurality of electrodes.

BRIEF DESCRIPTION OF THE DRAWINGS

Other objects and aspects of the invention will become apparent from the following description of embodiments with reference to the accompanying drawings in which.

DETAILED DESCRIPTION OF EMBODIMENTS OF THE INVENTION

Figure 1:
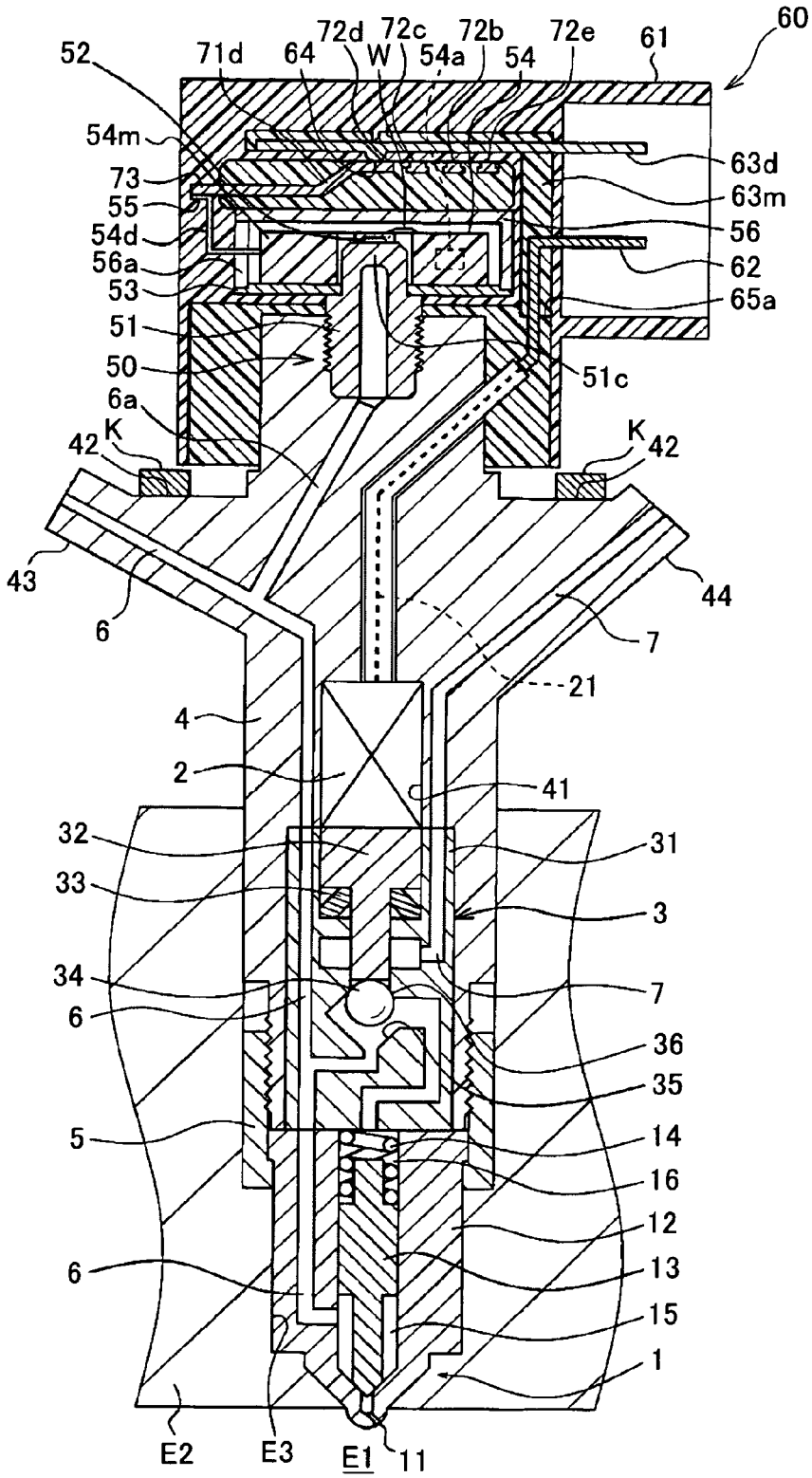
FIG. 1 is a longitudinal sectional view that shows an internal structure of a fuel injector according to the first embodiment of the present invention.

Embodiments of the present invention will be described hereinafter with reference to the accompanying drawings. In the drawings, identical reference characters are utilized to identify identical corresponding components.

First Embodiment

The first embodiment constructed by embodying one aspect of the present invention will be described hereinafter with reference to FIGS. 1 to 4. The first embodiment provides a fuel injector as being used in, for example, automotive common rail fuel injection systems for diesel engines.

The fuel injector is operative to inject, into a combustion chamber E1 in a cylinder of an internal combustion diesel engine, the high-pressurized fuel stored in a common rail (an accumulator), which is not illustrated in FIG. 1.

The fuel injector is comprised of a nozzle 1 from which the fuel is sprayed, an electrical actuator (driving member) 2 for actuating the nozzle 1 when energized, and a back-pressure control mechanism 3 driven by the electrical actuator 2 to control the back pressure acting on the nozzle 1.

The nozzle 1 is made up of a nozzle body 12 in which a spray hole(s) 11 is formed, a needle 13 movable into or out of abutment with an inner seat of the nozzle body 12 to close or open the spray hole 11, and a spring 14 operative to urge the needle 13 in a valve-closing direction to close the spray hole 11.

In the first embodiment, as the electrical actuator 2, a piezoelectric actuator is used. The piezoelectric actuator 2 includes a piezo stack made up of a plurality of laminated piezoelectric devices. The piezoelectric actuator 2 is designed to expand when electrically charged and to contract when discharged, thus functioning as an actuator to move the needle 13. As the electrical actuator, an electromagnetic actuator made up of a stator and an armature can be used.

The back-pressure control mechanism 3 includes a valve body 31 within which a piston 32, a disc spring 33, and a ball valve 34 are disposed. The piston 32 is movable with the stroke of the piezoelectric actuator 2. The disc spring 33 urges the piston 32 into constant abutment with the piezoelectric actuator 2. The ball valve 34 is movable by the piston 32. The valve body 31 is illustrated as being made by a one-piece member, but can be actually formed by a plurality of blocks.

The fuel injector also includes a substantially cylindrical injector body 4 in which a cylindrical mount chamber 41 is formed; this mount chamber 41 extends along a longitudinal axial direction of the fuel injector. The mount chamber 41 has an inner shoulder to define a small-diameter housing (that is, an upper housing, as viewed in FIG. 1) in which the piezoelectric actuator 2 is mounted and a large-diameter housing (that is, a lower housing, as viewed in FIG. 1) in which the back-pressure control mechanism 3 is mounted. A hollow cylindrical retainer 5 is threaded in the injector body 4 to retain the nozzle 1 within the head of the injector body 4.

The nozzle body 12, the injector body 4, and the valve body 31 have formed therein a high-pressure passage 6 through which the high-pressurized fuel is delivered from the common rail. The injector body 4 and the valve body 31 have also formed therein a low-pressure passage 7 that communicates with a fuel tank (not shown). The nozzle body 12, the injector body 4, and the valve body 31 are made of metallic material and to be fit in a mount hole E3 formed in a cylinder head E2 of the internal combustion diesel engine. The injector body 4 is formed with an outer shoulder 42 with which an end of a clamp K is to engage for securing the fuel injector in the mount hole E3 tightly. Specifically, installation of the fuel injector in the mount hole E3 is achieved by fastening the other end of the clamp K to the cylinder head E2 through a bolt to press the outer shoulder 42 into the mount hole E3.

Between the outer periphery of a top portion of the needle 13 close to the spray hole 11 and the inner periphery of the needle body 12, a high-pressure chamber 15 is formed; this high-pressure chamber 15 communicates with the high-pressure passage 6 to constitute a part of the high-pressure passage 6. The high-pressure chamber 15 establishes a fluid communication with the spray hole 11 when the needle 13 is lifted up in a valve-opening direction. A back-pressure chamber 16 is formed by one of ends of the needle 13; this one of the ends of the needle 13 is opposite to the spray hole 11. The spring 14 is disposed within the back-pressure chamber 16 to bias the needle 13 in the valve-closing direction.

The valve body 31 has formed therein a high-pressure seat 35 exposed to a fluid passage extending between the high-pressure passage 6 and the back-pressure chamber 16 in the nozzle 1. The valve body 31 has also formed therein a low-pressure seat 36 exposed to a passage extending between the low-pressure passage 7 and the back-pressure chamber 16. The low-pressure seat 36 faces the high-pressure seat 35 to define a valve chamber within which the ball valve 34 is disposed.

The injector body 4 is formed with, as shown in FIG. 1, a high-pressure port 43 (i.e., a high-pressure pipe connector) to which a high-pressure pipe (not shown) is connected, and with a low-pressure port 44 (i.e., a low-pressure pipe connector) to which a low-pressure pipe (not shown) is connected.

The fuel injector of the first embodiment is designed such that the fuel supplied from the common rail is delivered to the high-pressure port 43 through the high-pressure pipe, in other words, the fuel enters the cylindrical injector body 4 from its outer circumferential wall. The fuel, as having entered the fuel injector, passes through the high-pressure passage 6 to flow into the high-pressure chamber 15 and the back-pressure chamber 16.

The injector body 43 is formed with a branch passage 6*a* that diverges from the high-pressure passage 6 toward one axial end of the injector body 4; this one axial end is opposite to the other axial end formed with the spray hole 11. The branch passage 6*a* is operative to guide the fuel in the high-pressure passage 6 to a fuel pressure sensor 50 described later.

The fuel injector includes a connector 60 attached to the one axial end of the injector body 4. The connector 60 has an actuator drive terminal (drive connector terminal) 62 to which external electric power is supplied; this drive connector terminal 62 is electrically connected to the piezoelectric actuator 2. The electrical power supplied to the drive connector terminal 62 is supplied to the piezoelectric actuator 2 via a lead terminal 21; this results in that the piezoelectric actuator 2 expands. The stop of the supply of the electrical power to the piezoelectric actuator 2 via the drive connector terminal 62 causes the piezoelectric actuator 2 to contract.

When the piezoelectric actuator 2 is in a contracted state, the valve 34 is, as illustrated in FIG. 1, urged into abutment with the low-pressure seat 36 to establish fluid communication between the back-pressure chamber 16 and the high-pressure passage 6 so that the high-pressure fuel is supplied to the back-pressure chamber 16. This results in that the pressure of the fuel in the back-pressure chamber 16 and the elastic pressure produced by the spring 14 act on the needle 13 to urge it in the valve-closing direction so as to close the spray hole 11.

Alternatively, when the electric power is applied to the piezoelectric actuator 2 so that the piezoelectric actuator 2 is in an expanded state, the valve 34 is pushed into abutment with the high-pressure seat 35 to establish fluid communication between the back-pressure chamber 16 and the low-pressure passage 7 so that the pressure of the fuel in the back-pressure chamber 16 drops. This pressure drop causes the needle 13 to be biased by the pressure of the fuel in the high-pressure chamber 15 in the valve-opening direction so as to open the spray hole 11. This spray-hole opening sprays the fuel into the combustion chamber E1 of a corresponding cylinder of the engine.

The spraying of the fuel from the spray hole 11 may result in a variation in pressure of the fuel in the high-pressure passage 6. In order to measure such a fuel-pressure variation, the fuel injector is provided with the fuel pressure sensor 50 installed in the injector body 4. For example, a computer circuit, such as an ECU (Electronic Control System) for control of the engine, is electrically connected to the fuel pressure sensor 50 via the connector 60 described later.

When receiving, from the fuel pressure sensor 50, a signal indicative of the measured fuel-pressure variation, the ECU analyses the waveform of the received signal to thereby find the timing when the pressure of the fuel began to drop due to the spraying of the fuel from the spray hole 11. Based on the timing, the ECU determines the actual injection start timing of the fuel injector. The ECU also analyses the waveform of the received signal to thereby find the timing when the pressure of the fuel began to rise due to the termination of the spraying of the fuel from the spray hole 11. Based on the timing, the ECU determines the actual injection end timing of the fuel injector, that is, a period for which the spray hole 11 has been kept opened since the actual injection start timing.

The ECU further calculates a maximum value of the amount of drop in pressure of the fuel to thereby determine the quantity of fuel actually sprayed from the fuel injector.

Next, the structure of the fuel pressure sensor 50 and the installation thereof in the injector body 4 will be described hereinafter with reference to FIGS. 1 and 2.

The fuel pressure sensor 50 is provided with a stem (strain inducing member) 51, a strain gauge (sensing element) 52, a metal plate 53, a mold IC 54, and so on.

The stem 51 works as a pressure deformable member that is sensitive to the pressure of the high-pressurized fuel in the branch passage 6*a* to elastically deform. The strain gauge 52 works to convert the elastic deformation or distortion of the stem 51 into an electric signal as a detected value of the pressure of the high-pressurized fuel in the high-pressure passage 6. The mold IC 54 is operative to carry out various operations based on the electric signal outputted from the strain gauge 52. The plate 53 is designed to support the mold IC 54.

The stem 51 is made up of a hollow cylindrical body 51*b* and a circular plate-like diaphragm 51*c*.

The cylindrical body 51*b* is formed at its one axial end with a fuel inlet 51*a* into which the high-pressurized fuel from the branch passage 6*a* enters. The diaphragm 51*c* closes, at its one axial end surface, the other axial end of the cylindrical body 51*b*. The stem 51 is designed such that the inner wall surface of the cylindrical body 51*b* and the diaphragm 51*c* are subjected to the pressure of the high-pressurized fuel entering into the cylindrical body 51*b* from the fuel inlet 51*a* so that the whole of the stem 51 is deformed elastically.

The injector body 4 is provided with a mount chamber 45 formed as a cylindrical recess in the one axial end thereof; this one axial end is opposite to the other axial end formed with the spray hole 11. The cylindrical body 51*b* of the stem 51 is coaxially fitted in the mount chamber 45. The mount chamber 45 is formed at its inner circumferential surface with an internal thread. The cylindrical body 51*b* is formed at the outer circumferential surface of its substantially one axial half part with an external thread 51*d*; this one axial half part of the cylindrical body 51*b* is to be installed in the mount chamber 45 of the injector body 4 and has a diameter greater than that of the remaining axial half part of the cylindrical body 51*b*.

The installation of the stem 51 in the injector body 4 is achieved by inserting the stem 51 into the mount chamber 45 from the outside of the injector body 4 in the axial direction of the injector body 4 so as to engage the external thread 51*d* of the cylindrical body 51*b* with the internal thread of the mount chamber 45.

The strain gauge 52 is attached to the diaphragm 51*c*. Specifically, the strain gauge 52 is mounted on the other axial end surface of the diaphragm 51*c*; the other axial end surface is opposite to the one axial end surface of the diaphragm 51*c*. The strain gauge 52 mounted on the other axial end surface of the diaphragm 51*c* is encapsulated by a glass member 52*b* so as to be fixed thereon. When the stem 51 elastically expands according to the pressure of the high-pressurized fuel entering into the cylindrical body 51*b*, the diaphragm 51*c* is distorted. The strain gauge 52 detects the amount of distortion (elastic deformation) of the diaphragm 51*c*.

The metal plate 53 has, for example, a substantially circular shape with a central hole. The plate 53 is mounted on the stem 51 such that the other axial half part of the cylindrical body 51*b* is fitted in the central hole of the plate 53 to project therefrom. On the plate 53, the mold IC 54, described in detail later, is mounted.

The mold IC 54 is made up of circuit components 54*a*, sensor terminals 54*b*, 54*c*, 54*d*, and 54*e*, and a resin mold package 54*m*. The circuit components 54*a* include a voltage applying circuit, an amplifier, and a filter, and electrically connected to the sensor terminals 54*b*, 54*c*, 54*d*, and 54*e*. The voltage amplifying circuit and the amplifier are electrically connected to the stain gauge 52 through wires W using, for example, wire-bonding techniques. The voltage amplifying circuit is operative to amply a voltage to the stain gauge 52 that constitutes a resistance bridge circuit. When the diaphragm 51*c* is elastically deformed, an output voltage of the resistance bridge circuit is changed depending on the elastic deformation of the diaphragm 51*e* so that the output voltage indicative of the change in the elastic deformation of the diaphragm 51*c* is transferred to the amplifier of the mold IC 54 as a detected value of the pressure of the high-pressurized fuel in the high-pressure passage 6. The output voltage of the resistance bridge circuit is amplified by the amplifier so as to be outputted, as a detected signal of the fuel pressure sensor 50, from one of the sensor terminals 54*b*, 54*c*, 54*d*, and 54*e*.

The resin mold package 54*m* has a substantially annular shape coaxially arranged around the other axial half part of the cylindrical body 51*b*, and is so placed on the plate 53 as to encapsulate the circuit components 54*a* and the sensor terminals 54*b*, 54*e*, 54*d*, and 54*e*. The sensor terminals 54*b*, 54*c*, 54*d*, and 54*e* project outwardly from the outer circumferential surface of the mold package 54*m*, and work as a terminal for outputting the detected signal of the fuel pressure sensor 50, a terminal for supplying the voltage to the voltage applying circuit, a ground terminal, and so on.

Each of the sensor terminals 54*b*, 54*c*, 54*d*, and 54*e* radially extends by a preset length, and is so bent as to extend by a preset length toward the one axial end of the injector body 4; this one axial end is opposite to the other axial end formed with the spray hole 11. The extending end of each of the sensor terminals 54*b*, 54*c*, 54*d*, and 54*e* is radially bent outwardly so as to be functioned as a connector 55. The positions of the connectors 55 of the respective sensor terminals 54*b*, 54*c*, 54*d*, and 54*e* are flush with each other in the axial direction of the injector body 4.

A substantially hollow cylindrical metal case 56 is mounted at its one end surface on the outer periphery of the plate 53. Most of the other axial half part of the cylindrical body 51*b*, the diaphragm 51*c*, the strain gauge 52, and the mold IC 54 are contained in a housing formed by the metal plate 53 and the metal case 56. The housing 53 and 56 blocks external noise to protect the strain gauge 52 and the mold IC 54 therefrom. The metal case 56 is formed at its circumferential sidewall with a window 56*a* communicating with the inside of the metal case 56. The sensor terminals 54*b*, 54*c*, 54*d*, and 54*e* outwardly extend from the inside of the metal case 56 through the window 56*a*.

The connector 60 has a substantially cylindrical resin-mold housing 61 with an opening end and a circumferential sidewall, a part of which outwardly projects in a radial direction of the injector body 4 to form, for example, a connector jack. The connector 60 includes a hollow cylindrical positioning holder 65 having one opening end and the other bottom end with a central through hole. The one end of the injector body 4 is fitted in the hollow portion of the cylindrical positioning holder 65 such that the other axial half part of the cylindrical body 51*b* is fitted in the central hole of the positioning holder 65 to project therefrom.

A preset part of the outer periphery of the bottom end of the positioning holder 65 is formed with a recessed shoulder 65*a*.

Figure 3A:
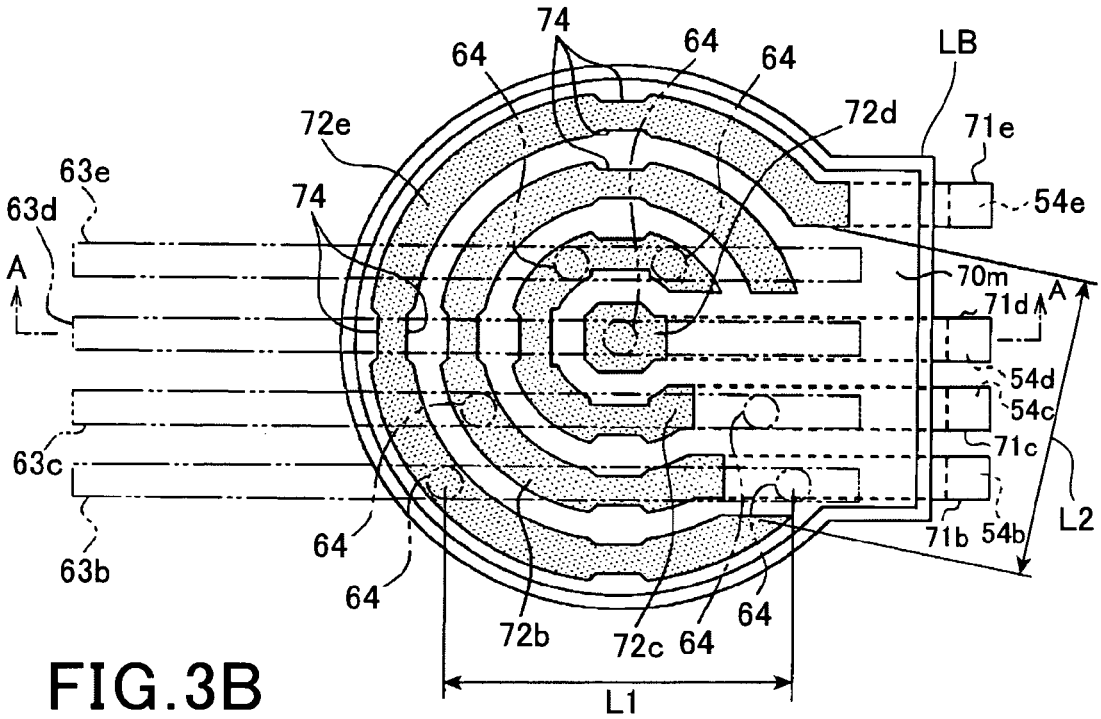
FIG. 3A is a plan view that shows an arrangement of a plurality of electrodes of a sensor assembly containing a fuel pressure sensor of the fuel injector according to the first embodiment.

The connector 60 includes a substantially cylindrical resin mold body 63*m* in which connector terminals 63*b*, 63*c*, 63*d*, and 63*e* are contained together with the drive connector terminal 62 (see FIG. 3A).

The resin mold body 63*m* has one part of the circular sidewall extending toward the injector body 4. The connector terminals 63*b*, 63*c*, 63*d*, and 63*e* are supported by the resin mold body 63*m* so as to project from the extending sidewall and extend linearly in a direction orthogonal to the axial direction of the injector body 4; this direction corresponds to a horizontal direction in FIG. 2. Similarly, the drive connector terminal 62 is supported by the extending sidewall so as to project therefrom and extend linearly in a direction parallel to the extending direction of each of the connector terminals 63*b* to 63*e*. The connector terminals 63*b*, 63*c*, 63*d*, and 63*e* are arranged to be flush with each other in the axial direction of the injector body 4.

The extending sidewall of the mold body 63*m* is fitted in the recessed shoulder 65*a* of the positioning holder 65 surrounding the inner surface of the housing 61 so that the connector terminals 63*b*, 63*c*, 63*d*, 63*e*, and the drive connector terminal 62 are so positioned in the connector jack as to be supported together by the positioning holder 65 and the housing 61.

For example, to the connector jack of the connector 60, a connector for external harnesses electrically connected to external circuits, such as the computer circuit (ECU) and the like, is joined to be electrically connected.

The fuel injector includes electrodes 71*b*, 71*c*, 71*d*, and 71*e*. The connector terminals 63*b*, 63*c*, 63*d*, and 63*e* are electrically connected to the sensor terminals 54*b*, 54*c*, 54*d*, and 54*e* via the electrodes 71*b*, 71*c*, 71*d*, and 71*e*, respectively; these electrodes 71*b*, 71*c*, 71*d*, and 71*e* will be described in detail later. In the first embodiment, the electrodes 71*b*, 71*c*, 71*d*, and 71*e* are electrically connected to the connector terminals 63*b*, 63*c*, 63*d*, and 63*e* and to the sensor terminals 54*b*, 54*c*, 54*d*, and 54*e* by laser welding, but these connections can be implemented by another method, such as soldering, fusing welding, resistance welding, or the like.

Figure 3B:
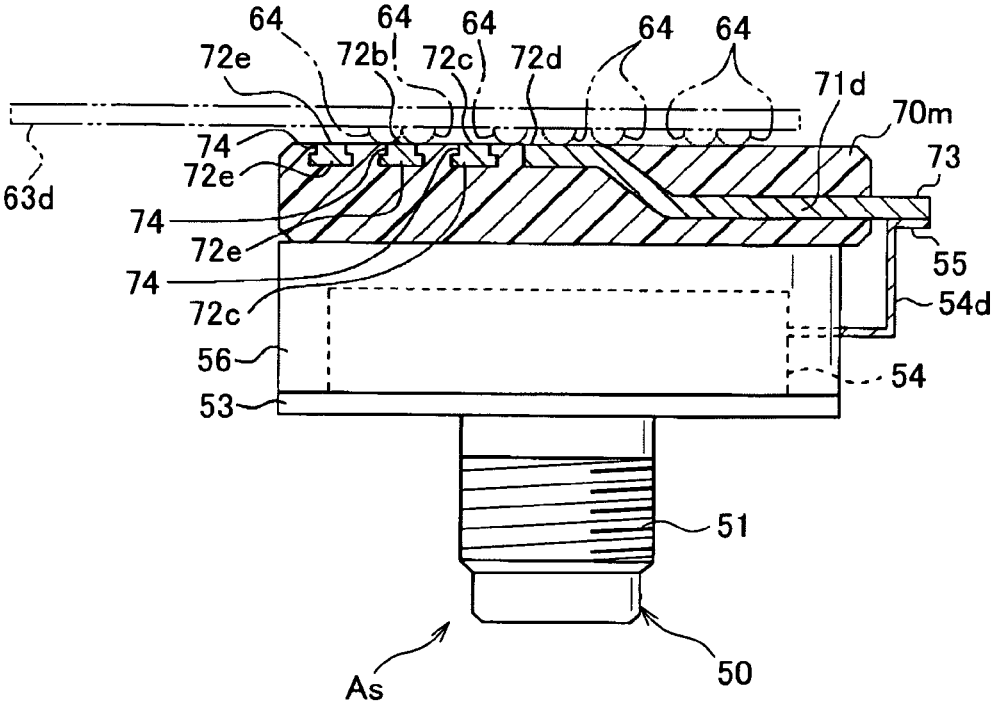
FIG. 3B is a partial cross sectional view of the sensor assembly illustrated in FIG. 3A taken on line A-A therein.

Next, the structure and arrangement of the electrodes 71*b* to 71*e* will be described in detail hereinafter with reference to mainly FIGS. 3A and 3B.

FIG. 3A schematically illustrates one end surface of a sensor assembly As of the fuel injector according to the first embodiment; this sensor assembly As is constructed by integrally assembling the fuel pressure sensor 50, the plate 53, the mold IC 54, the case 56, and the electrodes 71*b* to 71*e* to each other. The one end surface of the sensor assembly As is opposite to the other end thereof close to the injector body 4. FIG. 3B schematically illustrates a partial cross sectional view of the sensor assembly As taken on line A-A in FIG. 3A. Note that, in FIG. 3A, chain double-dashed lines represent the connector terminals 63*b* to 63*e*.

The electrodes 71*b* to 71*e* are integrated with each other by a substantially cylindrical resin mold body 70*m*. Specifically, the resin mold body 70*m* has a circumferential sidewall, a part of which outwardly projects in a radial direction of the stem 51 to form a rectangular electrode-lead portion LB. The resin mold body 70*m* in which the electrodes 71*b* to 71*e* are contained is mounted at its one end surface on the other end surface of the metal case 56; the other end surface of the metal case 56 is opposite to the one end surface mounted on the outer periphery of the plate 53.

One ends 73 of the electrodes 71*b* to 71*e* outwardly extend from the electrode-lead portion LB of the resin mold body 70*m* so as to be flush with each other in the axial direction of the stem 51. The one ends 73 of the electrodes 71*b*, 71*c*, 71*d*, and 71*e* are electrically connected to the connectors 55 of the sensor terminals 54*b*, 54*c*, 54*d*, and 54*e*, respectively.

The other ends of the electrodes 71*b*, 71*c*, and 71*e* extend in substantially circular arcs, such as substantially C-shapes, around the axial direction of the stem 51 at given radial pitches; these circular-arc ends of the electrodes 71*b*, 71*c*, and 71*e* serve as circular-arc connectors 72*b*, 72*c*, and 72*e*. The other end of the electrode 71*d* located on the axial direction of the stem 51 serves as a center connector 72*d*. These connectors 72*b*, 72*c*, 72*d*, and 72*e* are represented by dot-hatched portions in FIG. 3A.

The circular-arc connectors 72*c*, 72*b*, and 72*e* are radially arranged around the center connector 72*d* in this order. One of major surfaces of the connectors 72*b* to 72*e* are exposed on the other end surface of the resin mold body 70*m*; the other end surface is opposite to the one end surface of the resin mold body 70*m* mounted on the other end surface of the metal case 56. These exposed surfaces of the connectors 72*b* to 72*e* are flush with each other in the axial direction of the stem 51.

Each of the circular-arc connectors 72*b*, 72*c*, and 72*e* has a plurality of inner shoulders 74 inwardly recessed in each of the inner and outer circumferential sides thereof from the exposed surface so that part of the resin mold body 70*m* is fitted in each of the inner shoulders 74 of the circular-arc connectors 72*b*, 72*c*, and 72*e*. The part of the resin mold body 70*m* fitted in each of the inner shoulders 74 of the circular-arc connectors 72*b*, 72*c*, and 72*e* prevents the circular-arc connectors 72*b*, 72*c*, and 72*e* from being detached from the resin mold body 70*m*.

Each of the electrodes 71*b* to 71*e* has an arm portion joining the corresponding extending end 73 and a corresponding one of the connectors 72*b* to 72*e*. Referring to FIG. 3B, each of the electrodes 71*b* to 71*e* is bent to form the corresponding arm portion such that a corresponding one of the extending ends 73 is lower in height relative to the case than a corresponding one of the connectors 72*b* to 72*e*.

The arm portions of the electrodes 71*b* to 71*d* are arranged between both ends of the circular-arc connector 72*e*. The arm portions of the electrodes 71*c* and 71*d* are arranged between both ends of the circular-arc connector 72*b*. The arm portion of the electrode 71*d* is arranged between both ends of the circular-arc connector 72*c*.

The connector terminals 63*b* to 63*e* are arranged to linearly extend so that they are parallel to each other in a direction orthogonal to the axial direction of the stem 51. For example, the connector terminal 63*d* is arranged to linearly extend in a corresponding radial direction of the stem 51 and to pass through the axial end of the stem 51. The connector terminals 63*b*, 63*c*, and 63*e* are arranged in parallel to the connector terminal 63*d*.

The connector terminal 63*b* is so formed with two hemispherical conductive joint portions, such as metal join portions, 64 as to project toward an annular region on which the circular-arc connector 72*e* is expected to be mounted.

The connector terminal 63*c* is so formed with two hemispherical joint portions 64 as to project toward an annular region on which the circular-arc connector 72*b* is expected to be mounted.

The connector terminal 63*e* is so formed with two hemispherical joint portions 64 as to project toward an annular region on which the circular-arc connector 72*c* is expected to be mounted.

The connector terminal 63*d* is so formed with a single hemispherical joint portion 64 as to project toward the connector 72*d*.

For example, each of the joint portions 64 is formed using press molding.

The pitch L1 between the two joint portions 64 of each of the connector terminals 63*b*, 63*c*, and 63*e* is set to be longer than the interval L2 between both ends of a corresponding one of the circular-arc connectors 72*b*, 72*c*, and 72*e*.

The top wall of the resin mold body 63*m* is formed with a plurality of through holes 63*h* in line with the plurality of joint portions 64, respectively.

Next, the procedure to install the fuel pressure sensor 50 and the like in the injector body 4 and the procedure to electrically connect each of the sensor terminals 54*b* to 54*e* to a corresponding one of the connector terminals 63*b* to 63*e* via a corresponding one of the electrodes 71*b* to 71*e* will be described hereinafter.

First, the sensor assembly As illustrated in FIG. 3A is assembled.

Specifically, the plate 53 is coaxially mounted on the stem 51 to which the strain gauge 52 has been attached, so that the other axial half part of the cylindrical body 51*b* is fitted in the central hole of the plate 53 to project therefrom. The mold IC 54 is coaxially placed on the plate 53. Thereafter, the circuit components 54*a* of the mold IC 54 and the strain gauge 52 are electrically connected to each other through the wires W by a prepared bonding machine using wire-bonding techniques.

The metal case 56 is mounted at its one end surface on the outer periphery of the plate 53.

On the other hand, the electrodes 71*b* to 71*e* are molded from resin so that the resin mold body 70*m* in which the electrodes 71*b* to 71*e* are contained is formed. The resin mold body 70*m* is mounted at its one end surface on the other end surface of the metal case 56; the other end surface of the metal case 56 is opposite to the one end surface mounted on the outer periphery of the plate 53.

The ends 73 of the electrodes 71*b* to 71*e* outwardly extending from the resin mold body 70*m* are electrically connected to the connectors 55 of the sensor terminals 54*b*, 54*c*, 54*d*, and 54*e*, respectively using, for example, laser-welding techniques (sensor-terminal connection step). This results in that the assembling of the sensor assembly As is completed.

Figure 4A:
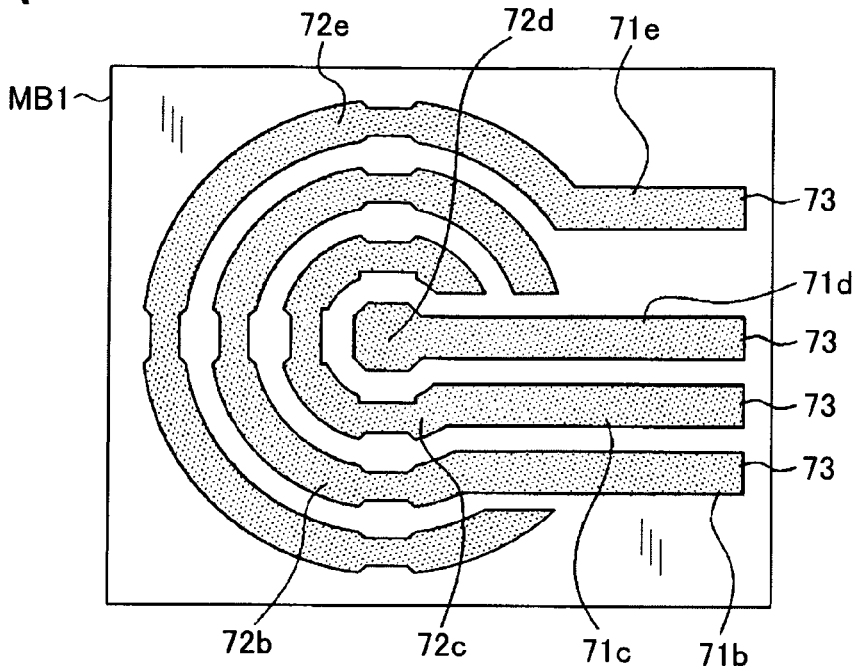
FIG. 4A is a plan view of a base material plate including the plurality of electrodes illustrated in FIGS. 3A and 3B according to the first embodiment.

Note that the electrodes 71*b* to 71*e* are formed by punching the electrodes 71*b* to 71*e* out of a single base material (base metal plate) MB1 in a press (see FIG. 4A). Thereafter, each of the electrodes 71*b* to 71*e* is bent at a boundary between a corresponding arm portion and a corresponding connector by a preset acute angle so that a corresponding connector is higher than a corresponding arm portion.

In addition, each of the electrodes 71*b* to 71*e* is bent at a boundary between a corresponding arm portion and a corresponding end 73 by, for example, the same preset acute angle so that a corresponding end 73 is in parallel to a corresponding connector. Thus, each of the electrodes 71*b* to 71*e* having a corresponding connector, a corresponding arm portion, and a corresponding end 73 is formed. This makes it possible to prevent at least one joint portion 64 from being in abutment with another one of the connectors 72*b* to 72*e* except for one connector corresponding to the at least one joint portion 64.

Next, the sensor assembly As is installed in the injector body 4. Specifically, the stem 51 of the sensor assembly As is inserted into the mount chamber 45 from the outside of the injector body 4 in the axial direction thereof while being rotated about its axial direction; the positioning holder 65 has been covered around the one end of the injector body 4. This results in that the external thread 51*d* is meshed with the internal thread of the mount chamber 45 (assembly installation step).

Figure 2:
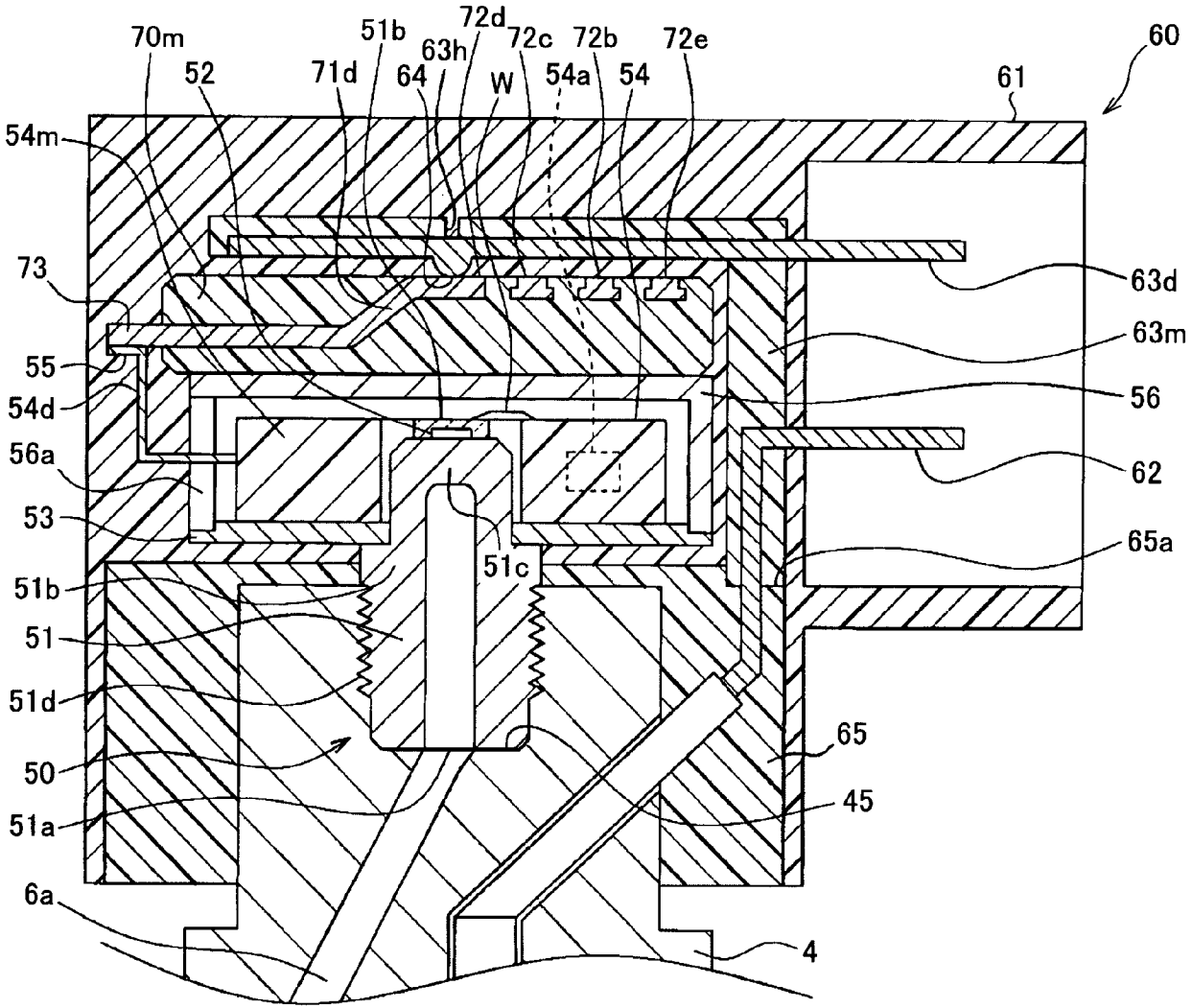
FIG. 2 is a partially enlarged view of FIG. 2.

Thereafter, as illustrated in FIG. 2, the drive connector terminal 62 and the connector terminals 63*b* to 63*e* are molded from resin so that the resin mold body 63*m* in which the drive connector terminal 62 and the connector terminals 63*b* to 63*e* are integrally contained is formed. The mold body 63*m* is fitted in the recessed shoulder 65*a* of the positioning holder 65 so that the connector terminals 63*b*, 63*c*, 63*d*, 63*e*, and the drive connector terminal 62 are so positioned in the connector jack of the connector 60 as to be supported together by the positioning holder 65.

That is, the positioning holder 65 locates the connector terminals 63*b*, 63*c*, 63*d*, and 63*e* at the predetermined positions in the axial direction, the circumferential direction, and radial directions of the injector body 4.

Thereafter, the drive connector terminal 62 and the lead electrode 21 are electrically connected to each other, and each of the connector terminals 63*b* to 63*e* is electrically connected to a corresponding one of the electrodes 71*b* to 71*e* using, for example, laser-welding techniques (connector-terminal connection step).

Specifically, a laser beam is irradiated to each of the joint portions 64 through a corresponding one of the through holes 63*h* independently of whether a joint portion 64 to be irradiated by the laser beam faces a corresponding circular-arc connector. This results in that, when some of the joint portions 64 face the corresponding circular-arc connectors 72*b*, 72*c*, 72*d*, and 72*e*, some of the joint portions 64 are electrically and fixedly joined to the corresponding circular-arc connectors 72*b*, 72*c*, 72*d*, and 72*e*.

Because each of the joint portions 64 is designed to project toward a corresponding one of the circular-arc connectors 72*b*, 72*c*, 72*d*, and 72, when at least one of the joint portions 64 is fixedly joined to a corresponding one of the circular-arc connectors 72*b*, 72*c*, 72*d*, and 72 using laser welding, it is possible to easily concentrate laser energy to the projecting end of he at least one of the joint portions 64.

Next, the molded connector terminals 62 and 63*b* to 63*e*, the positioning holder 65, and the sensor assembly As mounted on the one end of the injector body 4 are molded from resin so that the resin-mold housing 61 is formed to cover the sensor assembly As and the connector terminals 63*b* to 63*e*.

As a result, the installation of the fuel pressure sensor 50 and the like in the injector body 4 and the internal electrical connections in the fuel injector are completed.

As described above, in order to produce a plurality of the fuel injectors according to the first embodiment, the sensor assembly As is screwed into the injector body 4 of each of the fuel injectors. At the moment when the screwing of the stem 51 into the injector body 4 of each fuel injector is completed, rotational positions of the sensor terminals 54*b* to 54*e* of each fuel pressure sensor may be different from those of the sensor terminals 54*b* to 54*e* of another one fuel pressure sensor.

In order to address such a drawback, in each the fuel injectors according to the first embodiment, the circular-arc connectors 72*b*, 72*c*, and 72*e* are formed on the corresponding electrodes 71*b*, 71*c*, and 71*e* so as to extent around the rotational direction (axial direction) of the stem 51. On the other hand, each of the connector terminals 63*b*, 63*c*, and 63*d* is so formed with two joint portions 64 as to project toward an annular region on which a corresponding circular-arc connector is expected to be mounted. The pitch L1 between the two joint portions 64 of each of the connector terminals 63*b*, 63*c*, and 63*e* is set to be longer than the interval L2 between both ends of a corresponding one of the circular-arc connectors 72*b*, 72*c*, and 72*e*.

Although the rotational positions of the sensor terminals 54*b* to 54*e* are not specified between the individual fuel injectors, this configuration of each of the individual fuel injectors allows at least one of the two joint portions 64 of each of the connector terminals 63*b*, 63*c*, and 63*e* to be located to face a corresponding one of the connectors 72*b*, 72*c*, and 72*e*. In addition, because the connector 72*d* is located on the rotational axis of the stem 51, the location of the connector 72*d* is specified independently of the rotation of the stem 51.

Because the electrodes 71*b* to 71*e* are electrically connected to the sensor terminals 54*b* to 54*e*, it is possible to easily establish electrical connections between each of the connector terminals 63*b* to 63*e* and a corresponding one of the sensor terminals 54*b* to 54*e* via the electrodes 71*b* to 71*d*.

The fuel injector according to the first embodiment also achieves the following benefits.

Specifically, the connectors 72*b* to 72*e* of the respective electrodes 71*b* to 71*e* are arranged at given radial pitches so as to be flush with each other in the rotational axis of the stem 51. In addition, the connector terminals 63*b* to 63*e* are so arranged in parallel to one radial direction of the rotational axis of the stem 51 at given pitches as to be flush with each other in the rotational axis of the stem 51. These arrangements make it easy to prevent the established electrical paths from interfering with each other.

Each of the connectors 72*b*, 72*c*, and 72*e* to be electrically connected to a corresponding at least one of the joint portions 64 has a substantially circular-arc shape. This configuration reduces the amount of the base material plate MB1 to be used to produce the electrodes 71*b* to 71*e* as compared with the amount of a base material plate MB2 to be used to produce electrodes 710*b* to 710*e* according to the second embodiment of the present invention described later.

Specifically, as illustrated in FIG. 4A, because each of the connectors 72*b*, 72*c*, and 72*e* according to the first embodiment has a circular-arc shape, the connectors 72*b*, 72*c*, and 72*e* can be concentrically arranged on the base material plate MB 1 around the connector 72*d*.

In contrast, because each of connectors 720*b* and 720*d* according to the second embodiment has a circular loop shape, the connectors 720*b* and 720*e* cannot be concentrically arranged on the base material plate MB2.

Thus, the fuel injector according to the first embodiment reduces the amount of the base material plate MB1 to be used to produce the electrodes 71*b* to 71*e*, thus reducing the cost required to produce the fuel injector.

Each of the circular-arc connectors 72*b*, 72*c*, and 72*e* has the inner shoulders 74 inwardly recessed in each of the inner and outer circumferential sides thereof so that part of the resin mold body 70*m* is fitted in each of the inner shoulders 74 of the circular-arc connectors 72*b*, 72*c*, and 72*e*. The part of the resin mold body 70*m* fitted in each of the inner shoulders 74 of the circular-arc connectors 72*b*, 72*c*, and 72*e* prevents the circular-arc connectors 72*b*, 72*c*, and 72*e* from floating so as to be detached from the resin mold body 70*m*.

The connectors 72*b* to 72*e* of the electrodes 71*b* to 71*e* are arranged to be flush with each other in the axial direction of the stem 51. This arrangement reduces the size of each of the connectors 72*b* to 72*e* in the axial direction of the stem 51, thus reducing the fuel injector according to the first embodiment in size in the axial direction of the stem 51.

The drive connector terminal 62 and the connector terminals 63*b* to 63*e* are held to the same connector housing 61 so that the connector terminals 62 and 63*b* to 63*e* are designed as the single connector (single connector jack) 60. For this reason, the fuel pressure sensor 50 is installed in the fuel injector without increasing the number of connectors. This configuration of the fuel injector allows harnesses for electrically connecting the connector 60 and external circuits to be collectively brought out from the connector 60. Thus, it is possible to simplify the arrangement of the harnesses, and save time and human power required to connect the harnesses to the connector terminals 62 and 63*b* to 63*e*.

Second Embodiment

Figure 4B:
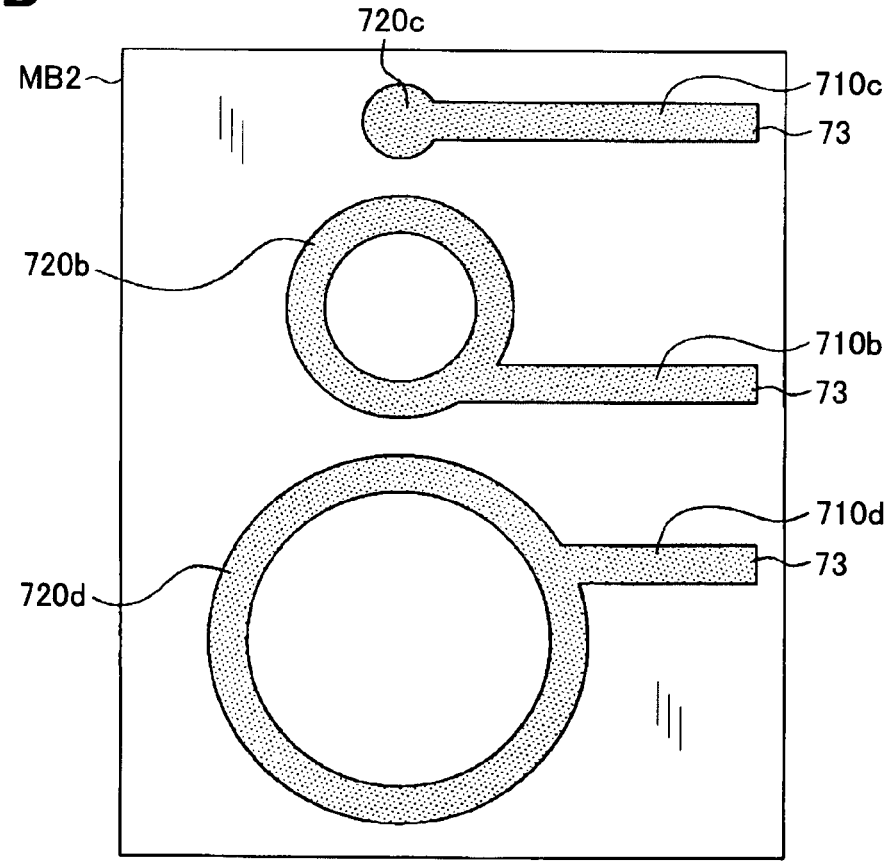
FIG. 4B is a plan view of a base material plate including a plurality of electrodes illustrated in FIGS. 5A and 5B according to the second embodiment.
Figure 5A:
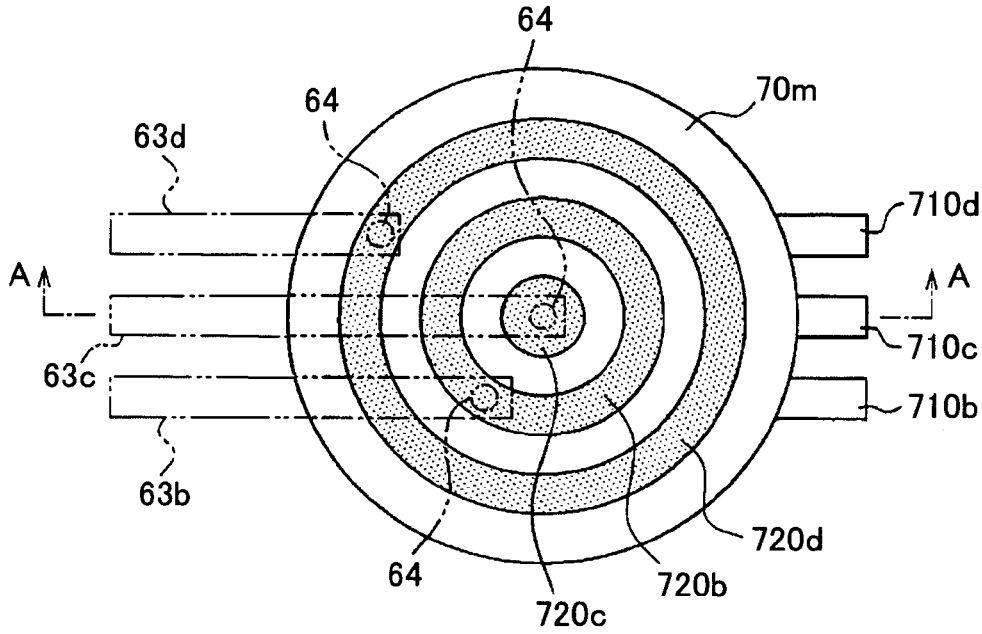
FIG. 5A is a plan view that shows an arrangement of a plurality of electrodes of a sensor assembly containing a fuel pressure sensor of a fuel injector according to the second embodiment.
Figure 5B:
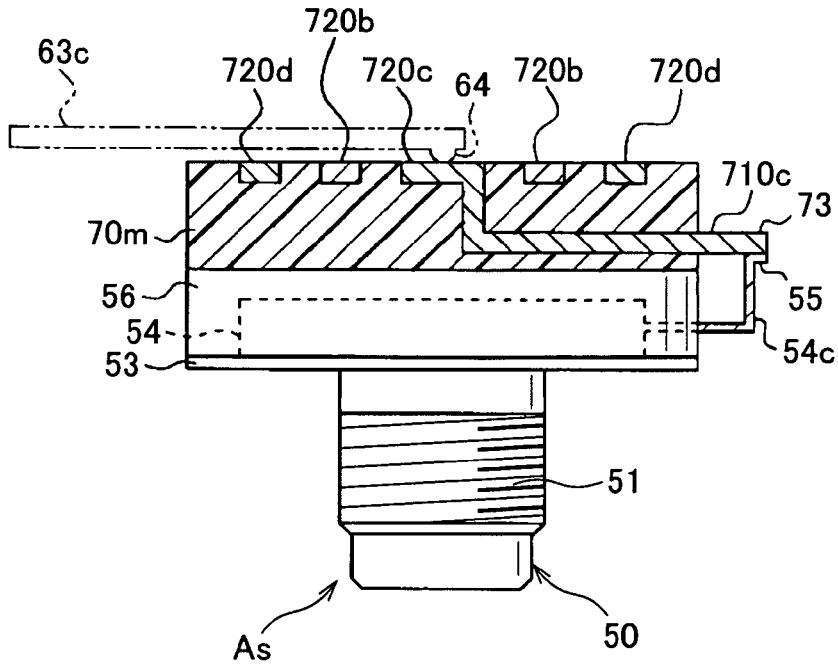
FIG. 5B is a partial cross sectional view of the sensor assembly illustrated in FIG. 5A taken on line A-A therein.

A fuel injector according to the second embodiment of the present invention will be described hereinafter with reference to FIGS. 4B, 5A and 5B.

The structure of the fuel injector according to the second embodiment is substantially identical to that of the fuel injector according to the first embodiment except for the following points. So, like parts between the fuel injectors according to the first and second embodiments, to which like reference characters are assigned, are omitted or simplified in description.

The fuel injector according to the first embodiment is configured such that each of the connectors 72*b*, 72*c*, and 72*e* of the electrodes 71*b* to 71*e* to be electrically connected to a corresponding at least one of the joint portions 64 extends in a circular arc around the axial direction of the stem 51.

In contrast, the fuel injector according to the second embodiment is configured such that each of connectors 720*b* and 720*d* of electrodes 710*b* to 710*d* to be electrically connected to a corresponding at least one of the joint portions 64 extends in a substantially circular loop around the axial direction of the stem 51.

Note that, in the second embodiment, the mold IC 54 includes three sensor terminals 54*b*, 54*c*, and 54*d*. The circular-loop connectors 720*b* and 720*d* are radially arranged around the connector 720*c* located on the axial direction of the stem 51 in this order. One of major surfaces of the connectors 720*b* to 720*d* are exposed on the other end surface of the resin mold body 70*m*; the other end surface is opposite to the one end surface of the resin mold body 70*m* mounted on the other end surface of the metal case 56. These exposed surfaces of the connectors 720*b* to 720*d* are flush with each other in the axial direction of the stem 51. These connectors 720*b*, 720*c*, and 720*d* are represented by dot-hatched portions in FIG. 5A.

As well as the first embodiment, the connector terminals 63*b* to 63*d* are arranged to linearly extend so that they are parallel to each other in a direction orthogonal to the axial direction of the stem 51.

In the first embodiment, two joint portions 64 are formed on two sites of each of the connector terminals 63*b*, 63*e*, and 63*e*; these two sites of each of the connector terminals 63*b*, 63*c*, and 63*e* face a corresponding one of the circular-arc connectors 72*b*, 72*c*, and 72*e*.

In contrast, in the second embodiment, one joint portion 64 is formed on one site of each of the connector terminals 63*b*, 63*c*, and 63*e*; the one site of each of the connector terminals 63*b*, 63*c*, and 63*e* faces a corresponding one of the circular-arc connectors 72*b*, 72*c*, and 72*e*.

As well as the first embodiment, the inner shoulders 74 can be formed in each of the inner and outer circumferential sides of each of the connectors 720*b* to 720*d*. In addition, as described above, the electrodes 710*b* to 710*d* are formed by punching the electrodes 710*b* to 710*d* out of a base material plate MB2 in a press (see FIG. 4B).

Thereafter, each of the electrodes 710*b* to 710*d* is bent at a boundary between a corresponding arm portion and a corresponding connector by a right angle so that a corresponding connector is higher than a corresponding arm portion. In addition, each of the electrodes 710*b* to 710*d* is bent at a boundary between a corresponding arm portion and a corresponding end 73 by, for example, a right angle so that a corresponding end 73 is in parallel to a corresponding connector. Thus, each of the electrodes 710*b* to 710*d* having a corresponding connector, a corresponding arm portion, and a corresponding end 73 is formed.

As described above, the fuel injector according to the second embodiment achieves the following benefits.

The circular-loop connectors 720*b* and 720*d* formed on the corresponding electrodes 710*b* and 710*d* are electrically connected around the rotational direction (axial direction) of the stem 51.

Although the rotational positions of the sensor terminals 54*b* to 54*e* are not specified between the individual fuel injectors, this configuration of each of the individual fuel injectors allows the joint portion 64 of each of the connector tee urinals 63*b* and 63*d* to be located to face a corresponding one of the connectors 720*b* and 720*d*. In addition, because the connector 720*c* is located on the rotational axis of the stem 51, the location of the connector 720*c* is specified independently of the rotation of the stem 51.

Because the electrodes 710*b* to 710*d* are electrically connected to the sensor terminals 54*b* to 54*d*, it is possible to easily establish electrical connections between each of the connector terminals 63*b* to 63*d* and a corresponding one of the sensor terminals 54*b* to 54*d* via the electrodes 710*b* to 710*d*.

Specifically, the connectors 720*b* to 720*d* of the respective electrodes 710*b* to 710*d* are arranged at given radial pitches so as to be flush with each other in the rotational axis of the stem 51. In addition, the connector terminals 63*b* to 63*d* are so arranged in parallel to one radial direction of the rotational axis of the stem 51 at given pitches as to be flush with each other in the rotational axis of the stem 51. These arrangements make it easy to prevent the established electrical paths from interfering with each other.

Note that, in the second embodiment, in order to form each of the electrodes 710*b* to 710*d*, a connector, an arm joint, and an extending end 73 are integrally punched out of the base material plate MB2 in a press. However, in order to form each of the electrodes 710*b* to 710*d*, a connector and an arm joint with an extending end can be individually punched out of the base material plate MB2. This allows the connectors 720*b* to 720*d* to be concentrically arranged on the base material plate MB2 around the connector 720*c*. Thus, the fuel injector according to the second embodiment reduces the amount of the base material plate MB2 to be used to produce the electrodes 710*b* to 710*d*, thus reducing the cost required to produce the fuel injector.

Third Embodiment

A fuel injector according to the third embodiment of the present invention will be described hereinafter with reference to FIGS. 6A and 6B.

The structure of the fuel injector according to the third embodiment is substantially identical to that of the fuel injector according to the first embodiment except for the following points. So, like parts between the fuel injectors according to the first and third embodiments, to which like reference characters are assigned, are omitted or simplified in description.

In the first embodiment, the stem 51 is threadedly fastened into the injector body 4 with the electrodes 71*b* to 71*e* being electrically connected to the sensor terminals 54*b* to 54*e*, respectively.

Figure 6A:
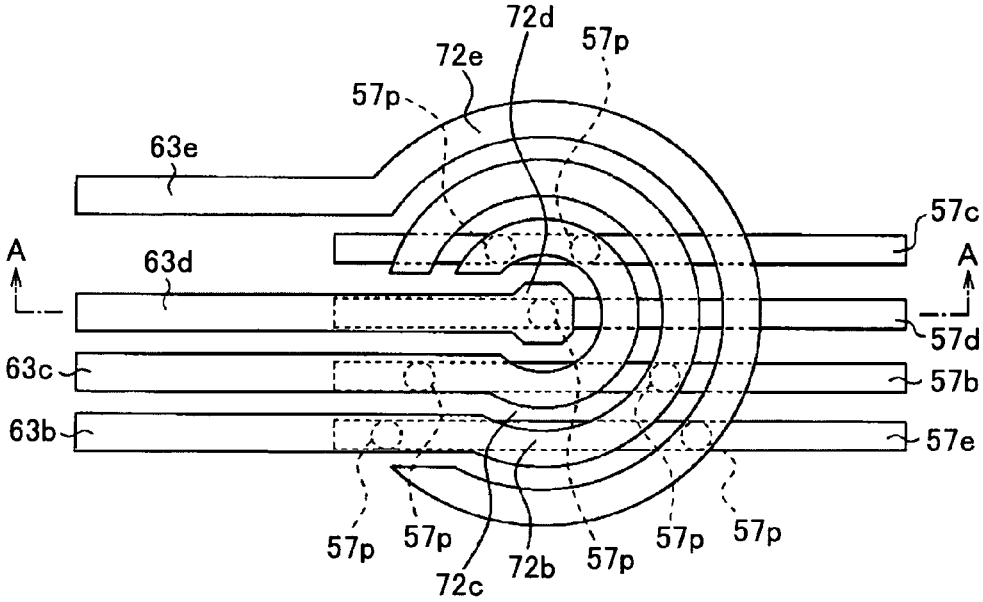
FIG. 6A is a plan view that shows an arrangement of a plurality of electrodes of a sensor assembly containing a fuel pressure sensor of a fuel injector according to the third embodiment.
Figure 6B:
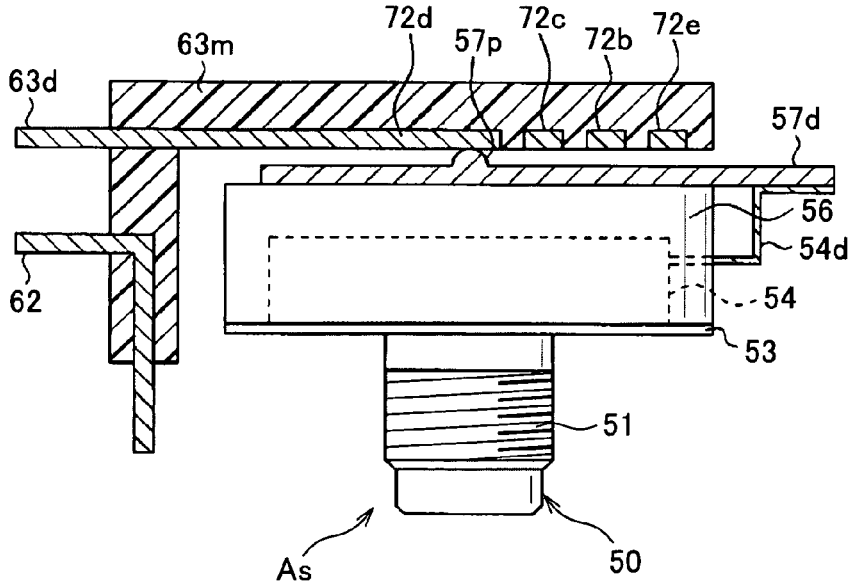
FIG. 6B is a partial cross sectional view of the sensor assembly illustrated in FIG. 6A taken on line A-A therein.

In contrast, in the third embodiment illustrated in FIGS. 6A and 6B, the connectors 72*b* to 72*e* are formed on the respective connector terminals 63*b* to 63*e*, and the stem 51 is threadedly fastened into the injector body 4 without the connectors 72*b* to 72*e* being electrically connected to the sensor terminals 54*b* to 54*e*.

Specifically, the connector terminals 63*b* to 63*e* are integrated with each other by the substantially cylindrical resin mold body 63*m*. Specifically, the resin mold body 63*m*. The resin mold body 63*m* in which the connector terminals 63*b* to 63*e* are contained is mounted at its one end surface on connector terminals 57*b* to 57*e* mounted on the other end surface of the metal case 56; the other end surface of the metal case 56 is opposite to the one end surface mounted on the outer periphery of the plate 53. The connector terminals 57*b* to 57*e* are so arranged as to parallely extend linearly in a radial direction of the stem 51 and they flush with each other in the axial direction of the injector body 4. The connector terminals 57*b* to 57*e* are electrically connected to the sensor terminals 54*b* to 54*e*, respectively.

The connector terminals 57*b* to 57*e* and the sensor terminals 54*b* to 54*e* can be integrally formed in a press. In addition, the connector terminals 57*b* to 57*e* and the sensor terminals 54*b* to 54*e* can be individually formed in a press, and the connector terminals 57*b* to 57*e* and the sensor terminals 54*b* to 54*e* can be joined to each other in laser welding.

One ends of the connector terminals 63*b*, 63*c*, 63*d*, and 63*e* are supported by the mold body 63*m* so as to project from the extending sidewall and extend linearly in a direction orthogonal to the axial direction of the injector body 4. The one ends of the connector terminals 63*b*, 63*c*, 63*d*, and 63*e* are arranged to be flush with each other in the axial direction of the injector body 4.

The other ends of the connector terminals 63*b*, 63*c*, and 63*e* extend in substantially circular arcs, such as substantially C-shapes, around the axial direction of the stem 51 at given radial pitches; these circular-arc ends of the electrodes 63*b*, 63*c*, and 63*e* serve as circular-arc connectors 72*b*, 72*c*, and 72*e*. The other end of the connector terminal 63*d* located on the axial direction of the stem 51 serves as a center connector 72*d*.

The circular-arc connectors 72*c*, 72*b*, and 72*e* are radially arranged around the center connector 72*d* in this order. One of major surfaces of the connectors 72*b* to 72*e* are exposed on one end surface of the mold body 63*m*, which face the connector terminals 57*b* to 57*d*. These exposed surfaces of the connectors 72*b* to 72*e* are flush with each other in the axial direction of the stem 51.

The connector terminal 57*b* is so formed with two hemispherical joint portions 57*p* as to project toward an annular region on which the circular-arc connector 72*b* is expected to be mounted.

The connector terminal 57*c* is so formed with two hemispherical joint portions 57*p* as to project toward an annular region on which the circular-arc connector 72*c* is expected to be mounted.

The connector terminal 57*e* is so formed with two hemispherical joint portions 57*p* as to project toward an annular region on which the circular-arc connector 72*e* is expected to be mounted.

The connector terminal 57*d* is so formed with a single hemispherical joint portion 57*p* as to project toward the connector 72*d*.

For example, each of the joint portions 57*p* is formed using press molding.

The pitch between the two joint portions 57*p* of each of the connector terminals 57*b*, 57*c*, and 57*e* is set to be longer than the interval between both ends of a corresponding one of the circular-arc connectors 72*b*, 72*c*, and 72*e*.

The connector terminals 63*b* to 63*e* and the connectors 72*b* to 72*d* can be integrally formed in press molding.

In addition, the connector terminals 63*b* to 63*e* and the connectors 72*b* to 72*d* can be individually formed in a press, and the connector terminals 63*b* to 63*e* and the connectors 72*b* to 72*d* can be joined to each other in laser welding.

Next, the procedure to electrically connect each of the sensor terminals 54*b* to 54*e* to a corresponding one of the connector terminals 63*b* to 63*e* will be described hereinafter.

The stem 51 is threadably fastened into the mount chamber 45 of the injector body 4 so that the external thread 51*d* of the stem 51 is meshed with the internal thread of the mount chamber 45 (fastening step). In other words, the step 51 is screwed into the mount chamber 45 of the injector body 4 while the connector terminals 57*b* to 57*d* is rotated together with the screwing of the stem 51.

Next, as illustrated in FIG. 6B, the drive connector terminal 62 and the connector terminals 63*b* to 63*e* having the respective connectors 72*b* to 72*e* are molded from resin so that the resin mold body 63*m* in which the drive connector terminal 62 and the connector terminals 63*b* to 63*e* are integrally contained is formed. Like the first embodiment, the mold body 63*m* is fitted in the recessed shoulder 65*a* of the positioning holder 65 so that the connector terminals 63*b*, 63*c*, 63*d*, 63*e*, and the drive connector terminal 62 are so positioned in the connector jack of the connector 60 as to be supported together by the positioning holder 65.

That is, the positioning holder 65 locates the connector terminals 63*b*, 63*c*, 63*d*, and 63*e* at the predetermined positions in the axial direction, the circumferential direction, and radial directions of the injector body 4.

Thereafter, the drive connector terminal 62 and the lead electrode 21 are electrically connected to each other, and each of the connectors 72*b* to 72*e* of the connector terminals 63*b* to 63*e* is electrically connected to a corresponding one of the connector terminals 57*b* to 57*e* of the sensor terminals 54*b* to 54*e* using, for example, laser-welding techniques (connector-terminal connection step).

Next, the molded connector terminals 62 and 63*b* to 63*e*, the positioning holder 65, and the sensor assembly As mounted on the one end of the injector body 4 are molded from resin so that the resin-mold housing 61 is formed to cover the sensor assembly As and the connector terminals 63*b* to 63*e*.

As a result, the installation of the fuel pressure sensor 50 and the like in the injector body 4 and the internal electrical connections in the fuel injector are completed.

As described above, the circular-arc connectors 72*b*, 72*c*, and 72*e* are formed on the corresponding connector terminals 63*b*, 63*c*, and 63*e* so as to extend around the rotational direction (axial direction) of the stem 51. On the other hand, each of the sensor terminals 57*b*, 57*c*, and 57*d* is so formed with two conductive joint portions, such as metal joint portions, 57*p* as to project toward an annular region on which a corresponding circular-arc connector is expected to be mounted. The pitch between the two joint portions 57*p* of each of the sensor terminals 57*b*, 57*c*, and 57*e* is set to be longer than the interval between both ends of a corresponding one of the circular-arc connectors 72*b*, 72*c*, and 72*e*.

Although the rotational positions of the connector terminals 57*b* to 57*e* of the sensor terminals 54*b* to 54*e* are not specified between the individual fuel injectors, this configuration of each of the individual fuel injectors allows at least one of the two joint portions 57*p* of each of the sensor terminals 57*b*, 57*c*, and 57*e* to be located to face a corresponding one of the connectors 72*b*, 72*c*, and 72*e*. In addition, because the connector 72*d* is located on the rotational axis of the stem 51, the location of the connector 72*d* is specified independently of the rotation of the stem 51.

Because the connector terminals 63*b* to 63*e* are electrically connected to the sensor terminals 54*b* to 54*d*, it is possible to easily establish electrical connections between each of the connector terminals 63*b* to 63*e* and a corresponding one of the sensor terminals 54*b* to 54*e* via the connectors 72*b* to 72*e*.

Fourth Embodiment

A fuel injector according to the fourth embodiment of the present invention will be described hereinafter with reference to FIGS. 7A and 7B.

The structure of the fuel injector according to the fourth embodiment is substantially identical to that of the fuel injector according to the first embodiment except for the following points. So, like parts between the fuel injectors according to the first and fourth embodiments, to which like reference characters are assigned, are omitted or simplified in description.

In the first embodiment, each of the electrodes 71*b* to 71*e* is bent to form the corresponding arm portion such that a corresponding one of the extending ends 73 is lower in height relative to the case than a corresponding one of the connectors 72*b* to 72*e*. The configuration prevents at least one joint portion 64 from being in abutment with another one of the connectors 72*b* to 72*e* except for one connector corresponding to the at least one joint portion 64.

Figure 7A:
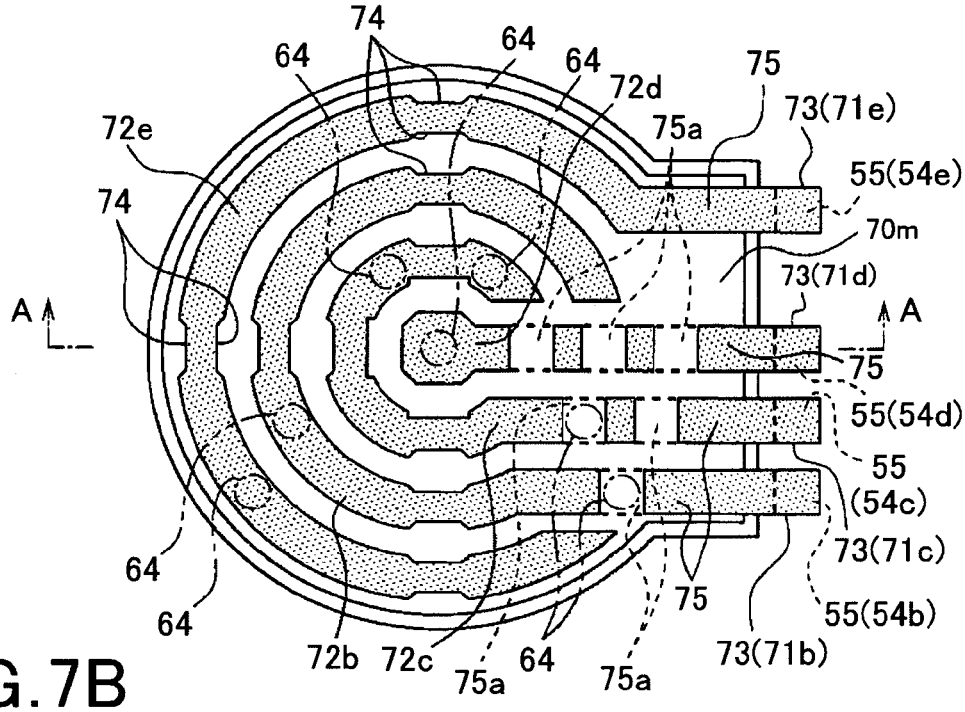
FIG. 7A is a plan view that shows an arrangement of a plurality of electrodes of a sensor assembly containing a fuel pressure sensor of a fuel injector according to the fourth embodiment.
Figure 7B:
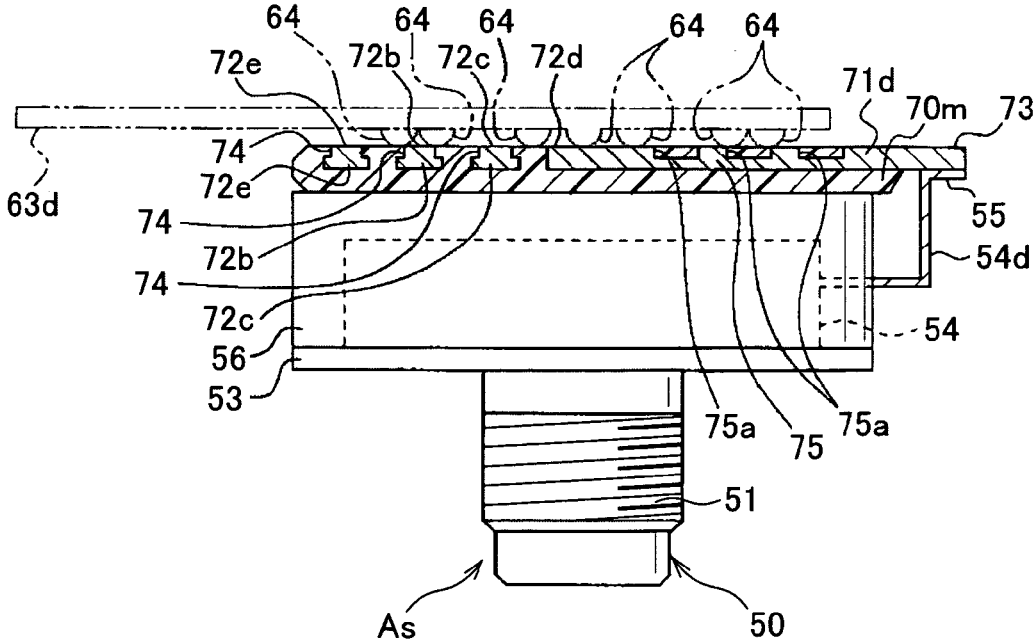
FIG. 7B is a partial cross sectional view of the sensor assembly illustrated in FIG. 7A taken on line A-A therein.

In contrast, in the fourth embodiment illustrated in FIGS. 7A and 7B, an arm portion 75 of each of the electrodes 71*b* to 71*e* linearly extends from a corresponding one of the connectors 72*b* to 72*e* up to a corresponding one of the extending ends 73 so that a corresponding one of the extending ends 73 is flush with a corresponding one of the connectors 72*b* to 72*e* in the axial direction of the stem 51.

In addition, the arm portion 75 of each of the electrodes 71*b* to 71*e* is formed at its at least one section with a groove 75*a* in, for example, a press; this at least one section faces another electrode. The groove 75*a* is concaved in one surface of at least one section of the arm portion 75 to reduce the thickness of the arm portion 75 in the axial direction of the stem 51. The configuration allows part of the resin mold member 70*m* to be fitted in the groove 75*a*. This makes it possible to prevent the joint portions 64 of, for example, the connector terminal 63*b* from being in abutment with the arm portions 75 of the electrodes 72*b*, 72*c*, and 72*d* except for the electrode 72*e* corresponding to the connector terminal 63*b*. Note that the exposed portions of the electrodes 71*b* to 71*e* from the resin mold body 70*m* are represented by dot-hatched portions in FIG. 7A.

As described above, in the fuel injector according to the fourth embodiment, the groove 75*a* formed on the arm portion of each of the electrodes 63*b* to 63*e* eliminates the need to bend each of the electrodes 71*b* to 71*e*, thus improving the productivity of the fuel injector according to the fourth embodiment. In addition, the elimination of the bending of each of the electrodes 71*b* to 71*e* allows the length of the resin mold body 70*m* in the axial direction of the stem 51 to be reduced, making it possible to reduce the fuel injector in size in its axial direction.

The present invention is not limited to the first to fourth embodiments, and therefore, the first to fourth embodiments can be modified as follows, or the subject matters of the respective first to fourth embodiments can be combined with one another.

In the first embodiment, the sensor terminals 54*b* to 54*e* and the electrodes 71*b* to 71*e* are separately formed in, for example, press molding, but the sensor terminals 54*b* to 54*e* and the electrodes 71*b* to 71*e* can be integrally formed in, for example, press molding.

Each of the electrodes 71*b* to 71*e* according to the first embodiment consists of a corresponding one of the connectors 72*b* to 72*e*, a corresponding one extending end 73, and a corresponding one arm portion. However, each of electrodes 71*b* to 71*e* can consist of a corresponding one of the connectors 72*b* to 72*e*, and the extending ends 73 and the arm portions can be integrally formed together with the corresponding sensor terminals 54*b* to 54*e*. The arm portion formed on each of the sensor terminals 54*b* to 54*e* can be welded to a corresponding one of the connectors 72*b* to 72*e*.

In the third embodiment, as the connectors formed on the connector terminals 63*b* to 63*d*, the circular-arc connectors 72*b*, 72*c*, and 72*e* are applied, but the circular-loop connectors 720*b*, 720*c*, and 720*e* can be applied.

In each of the first to fourth embodiments, the present invention is applied to the injector configured such that the high-pressure port 43 is formed at the outer peripheral portion of the injector body 4, but the present invention is not limited to the application.

Specifically, the present invention can be applied to injectors configured such that the high-pressure port 43 is formed at the one axial end of the injector body 4, which is opposite to the other axial end formed with the spray hole 11, so that the high-pressurized fuel is supplied from the one axial end of the injector body 4.

In each of the first to fourth embodiments, the drive connector terminal 62 and the connector terminals 63*b* to 63*e* are supported by the same connector housing 61 so that the drive connector terminal 62 and the connector terminals 63*b* to 63*e* are designed as the single connector (single connector jack) 60. However, the drive connector terminal 62 and the connector terminals 63*b* to 63*e* can be supported by different connector housings so that the drive connector terminal 62 and the connector terminals 63*b* to 63*e* are designed as different connectors (different connector jacks).

In each of the first to fourth embodiments, as a sensing element for measuring the amount of distortion of the stem 51, the strain gauge 52 is used, but another sensing element, such as a piezoelectric device, can be used.

In each of the first to fourth embodiments, the external thread 51*d* is formed on the outer circumferential surface of the stem 51, but the external thread 51*d* can be formed on the metal plate 53 or the case 56. In this modification, the plate 53 or the case 56 constitutes a component of the fuel pressure sensor. In sum up, the present invention can be applied to fuel injectors configured such that the sensor terminals 54*b* to 54*e* are rotated together with the screwing of the fuel pressure sensor into the injector body 4.

In each of the first to fourth embodiments, the present invention is applied to the fuel injector installed in the internal combustion diesel engine, but can be applied to direct-injection gasoline engines that directly spray fuel into their combustion chambers E1.

While there has been described what is at present considered to be the embodiments and their modifications of the present invention, it will be understood that various modifications which are not described yet may be made therein, and it is intended to cover in the appended claims all such modifications as fall within the scope of the invention.

What is claimed is:

1. A fuel injector to be installed in an internal combustion engine to spray fuel from a spray hole, the fuel injector comprising:

a body having formed therein a spray hole and a fuel supply passage, the fuel supply passage being designed such that fuel supplied thereto is delivered to the spray hole;

a fuel pressure sensor designed to produce a signal indicative of a pressure of the fuel;

a plurality of first terminals attached to the fuel pressure sensor and including at least one terminal for outputting the signal indicative of the pressure of the fuel, the fuel pressure sensor being threadedly installed in the body by being rotated, together with the plurality of first terminals, about a preset axis;

a connector comprising a housing attached to the body, and a plurality of second terminals supported by the housing for external electric connection of the fuel pressure sensor; and a plurality of electrodes, each said electrode being arranged to extend around said preset axis in a circular arc, each of the plurality of electrodes electrically connecting a corresponding one of the plurality of first terminals to a corresponding one of the plurality of second terminals.

2. The fuel injector according to claim 1, wherein the plurality of electrodes are aligned at given pitches in a direction orthogonal to the preset axis.

3. The fuel injector according to claim 1, wherein each of the electrodes has both ends having an interval therebetween, the plurality of second terminals are arranged to be opposite to the plurality of electrodes, each of the plurality of second terminals is formed with at least two conductive joint portions having a preset pitch therebetween, each of the at least two conductive joint portions projecting toward a corresponding one of the plurality of electrodes, each of the plurality of second terminals is joined to a corresponding one of the plurality of electrodes via a corresponding at least one of the at least two conductive joint portions, and the preset pitch of the at least two joint portions of each of the plurality of electrodes is longer than the interval between both ends of a corresponding one of the plurality of electrodes.

4. The fuel injector according to claim 1, wherein each of the plurality of electrodes is comprised of:

a circular-arc end extending around the preset axis in a circular arc, the circular-arc end of each of the plurality of electrodes being electrically connected to a corresponding one of the plurality of second terminals;

a connector end extending in a direction orthogonal to the preset axis, the connector end being electrically connected to a corresponding one of the plurality of first terminals; and an arm member that joints the circular-arc end and the connector end.

5. The fuel injector according to claim 4, further comprising a mold body in which the plurality of electrodes are integrally contained, the circular-arc end of each of the plurality of electrodes being exposed on one surface of the mold body, the connector end of each of the plurality of electrodes projecting outwardly from the mold body.

6. The fuel injector according to claim 1, further comprising a mold body in which the plurality of electrodes are integrally contained, each of the plurality of electrodes has an end surface exposed on one surface of the mold body, and each of the plurality of electrodes has a recess inwardly formed therein from the end surface so that part of the mold body is fitted in the recess.

7. The fuel injector according to claim 1, wherein each of the plurality of electrodes has an end surface to be electrically connected to any one of: a corresponding one of the plurality of first terminals; and a corresponding one of the plurality of second terminals, and the end surfaces of the plurality of the electrodes are arranged to be flush with each other in the preset axis.

8. The fuel injector according to claim 1, further comprising:

a needle valve installed in the body and working to open and close the fuel supply passage;

a driving member working to actuate the needle valve to open or close the fuel supply passage when electric power is supplied thereto; and a drive terminal electrically connected to the driving member and operative to supply therethrough the electric power to the driving element, the drive terminal being supported by the housing, the plurality of second terminals, the drive terminal, and the housing constituting the connector for the fuel pressure sensor.

9. A fuel injector to be installed in an internal combustion engine to spray fuel from a spray hole, the fuel injector comprising:

a body having formed therein a spray hole and a fuel supply passage, the fuel supply passage being designed such that fuel supplied thereto is delivered to the spray hole;

a fuel pressure sensor designed to produce a signal indicative of a pressure of the fuel;

a plurality of first terminals attached to the fuel pressure sensor and including at least one terminal for outputting the signal indicative of the pressure of the fuel, the fuel pressure sensor being threadedly installed in the body by being rotated, together with the plurality of first terminals, about a preset axis;

a connector attached to the fuel pressure sensor for external electric connection of the fuel pressure sensor, the connector having a plurality of second terminals; and a plurality of electrodes, each said electrode being arranged to extend around said preset axis in a circular loop so that the plurality of electrodes are concentrically arranged, each of the plurality of electrodes electrically connecting a corresponding one of the plurality of first terminals to a corresponding one of the plurality of second terminals.

10. The fuel injector according to claim 9, wherein the plurality of electrodes are aligned at given pitches in a direction orthogonal to the preset axis.

11. The fuel injector according to claim 9, wherein the plurality of second terminals are arranged to be opposite to the plurality of electrodes, and each of the plurality of second terminals is formed with a conductive joint portion projecting toward a corresponding one of the plurality of electrodes, and each of the plurality of second terminals is joined to a corresponding one of the plurality of electrodes via the conductive joint portion.

12. The fuel injector according to claim 9, further comprising a mold body in which the plurality of electrodes are integrally contained, each of the plurality of electrodes has an end surface exposed on one surface of the mold body, and each of the plurality of electrodes has a recess inwardly formed therein from the end surface so that part of the mold body is fitted in the recess.

13. The fuel injector according to claim 9, wherein each of the plurality of electrodes has an end surface to be electrically connected to any one of: a corresponding one of the plurality of first terminals; and a corresponding one of the plurality of second terminals, and the end surfaces of the plurality of the electrodes are arranged to be flush with each other in the preset axis.

14. The fuel injector according to claim 9, further comprising:

a needle valve installed in the body and working to open and close the fuel supply passage;

a driving member working to actuate the needle valve to open or close the fuel supply passage when electric power is supplied thereto; and a drive terminal electrically connected to the driving member and operative to supply therethrough the electric power to the driving element, the drive terminal being supported by the housing, the plurality of second terminals, the drive terminal, and the housing constituting the connector for the fuel pressure sensor.

15. An electrical interconnection method of a fuel injector to be installed in an internal combustion engine to spray fuel from a spray hole, the fuel injector comprising:

a body having formed therein a spray hole and a fuel supply passage, the fuel supply passage being designed such that fuel supplied thereto is delivered to the spray hole;

a fuel pressure sensor designed to produce a signal indicative of a pressure of the fuel;

a plurality of first terminals attached to the fuel pressure sensor and including at least one terminal for outputting the signal indicative of the pressure of the fuel, the fuel pressure sensor being threadedly installed in the body by being rotated, together with the plurality of first terminals, about a preset axis;

a connector comprising a housing attached to the body, and a plurality of second terminals supported by the housing for external electric connection of the fuel pressure sensor; and a plurality of electrodes, each said electrode being arranged to extend around said preset axis in any one of a circular arc and a circular loop, each of the plurality of electrodes electrically connecting a corresponding one of the plurality of first terminals to a corresponding one of the plurality of second terminals, the electrical interconnection method comprising:

electrically connecting the plurality of electrodes to the plurality of first terminals of the fuel pressure sensor, respectively;

threadedly installing the fuel pressure sensor into the body of the fuel injector by rotating the fuel pressure sensor about said preset axis while the plurality of first terminals and the plurality of electrodes are rotated therewith; and electrically connecting the plurality of second terminals to the plurality of electrodes, respectively.

16. An electrical interconnection method of a fuel injector to be installed in an internal combustion engine to spray fuel from a spray hole, the fuel injector comprising:

a body having formed therein a spray hole and a fuel supply passage, the fuel supply passage being designed such that fuel supplied thereto is delivered to the spray hole;

a fuel pressure sensor designed to produce a signal indicative of a pressure of the fuel;

a plurality of first terminals attached to the fuel pressure sensor and including at least one terminal for outputting the signal indicative of the pressure of the fuel, the fuel pressure sensor being threadedly installed in the body by being rotated, together with the plurality of first terminals, about a preset axis;

a connector attached to the fuel pressure sensor for external electric connection of the fuel pressure sensor, the connector having a plurality of second terminals; and a plurality of electrodes, each said electrode being arranged to extend around said preset axis in either a circular arc or a circular loop, each of the plurality of electrodes electrically connecting a corresponding one of the plurality of first terminals to a corresponding one of the plurality of second terminals, the electrical interconnection method comprising:

electrically connecting the plurality of electrodes to the plurality of second terminals, respectively;

threadedly installing the fuel pressure sensor into the body of the fuel injector by rotating the fuel pressure sensor about said preset axis while the plurality of first terminals are rotated therewith; and electrically connecting the first terminals of the fuel pressure sensor to the plurality of electrodes, respectively.

* * * * *